US005784661A

United States Patent [19]

Evans et al.

[11] Patent Number: 5,784,661

[45] Date of Patent: Jul. 21, 1998

[54] PHOTOGRAPHIC PROCESSING APPARATUS

[75] Inventors: Gareth B. Evans, Hertfordshire; Anthony Earle, Harrow Weald; Nigel Wildman, North Harrow; Andrew D. Grimsey, Luton, all of England

[73] Assignee: Eastman Kodak Company, Rochester, N.Y.

[21] Appl. No.: 800,305

[22] Filed: Feb. 14, 1997

[30] Foreign Application Priority Data

Feb. 21, 1996 [GB] United Kingdom ..... 9603680

[51] Int. Cl.[6] ..... G03D 3/08

[52] U.S. Cl. ..... 396/618; 396/620; 396/622; 396/636; 396/645

[58] Field of Search ..... 396/564, 612, 396/618, 620, 622, 626, 627, 636, 652, 633, 646, 645

[56] References Cited

U.S. PATENT DOCUMENTS

| | | | |
|---|---|---|---|
| 4,068,250 | 1/1978 | Anderson et al. | 396/620 |
| 4,072,260 | 2/1978 | Dove | 396/652 |
| 4,188,108 | 2/1980 | Falomo | 396/652 |
| 4,641,939 | 2/1987 | Kitner | 396/645 |
| 4,929,976 | 5/1990 | Cumningham et al. | 396/620 |
| 5,270,762 | 12/1993 | Rosenburgh et al. | 396/626 |
| 5,339,131 | 8/1994 | Rosenburgh et al. | 396/626 |
| 5,387,499 | 2/1995 | Earle et al. | 396/620 |
| 5,418,592 | 5/1995 | Patton et al. | 396/626 |
| 5,432,581 | 7/1995 | Patton et al. | 396/620 |
| 5,452,043 | 9/1995 | Patton et al. | 396/626 |

FOREIGN PATENT DOCUMENTS

| | | |
|---|---|---|
| 0 559 028 | 9/1993 | European Pat. Off. . |
| 0 611 994 | 8/1994 | European Pat. Off. . |
| 0 623 849 | 11/1994 | European Pat. Off. . |
| 92/09932 | 6/1992 | WIPO . |

*Primary Examiner*—A. A. Mathews

*Attorney, Agent, or Firm*—Frank Pincelli; David A. Novais

[57] ABSTRACT

A high capacity, low volume processor is described in which the benefits associated with low volumes are obtained. The processor comprises an inner tank (50) which holds a volume of processing solution which is substantially less than that of an outer tank (40) in which it is placed. A rack insert (60) is provided inside the inner tank (50) to define a processing channel (62) therebetween. The inner tank (50) and rack insert (60) can be retro-fitted to existing processing tanks.

17 Claims, 3 Drawing Sheets

PHOTOGRAPHIC PROCESSING APPARATUS

FIELD OF THE INVENTION

The present invention relates to improvements in or relating to a photographic processing apparatus and is more particularly, although not exclusively, concerned with a photographic processing apparatus having a relatively high throughput.

BACKGROUND OF THE INVENTION

Multiple strand processors are well known and are more usually of the "leader belt" type, this type of processor being the most common type of high capacity processor in current use. In multiple strand processors, a strong plastic belt is permanently threaded through the processor. Paper webs which are to be processed are attached to the belt by means of clips. These processors are not normally directly linked to printers, chiefly because they can accommodate several webs at one time for processing and are supplied with webs from several printers.

Low solution replenishment rates are desirable since they minimize inefficiencies in chemical use and reduce the chemical effluent and volumes of effluent. Methods of addition of replenishment chemicals directly to processing solutions are well known which allow components of a solution to be kept separate from one another until mixing occurs in the solution in the processing tank. This avoids a chemical mixing operation for replenishment solutions and allows volumes of replenishment solutions to be minimized. The residence times of tank solutions is however increased as replenishment rates are reduced thus making low volumes of processing solution in a tank more valuable.

Low volume processing tanks are known in which, in order to reduce costs and minimize volumes, the number of drive rollers is minimized. In such a processing tank, any position on the paper web passes a roller during processing infrequently, perhaps only once during each process step. It is desirable to provide high solution agitation during process steps to facilitate the interchange between the processed material and the solutions. Contact with rollers is useful in providing agitation.

However, in high capacity photographic processors, it is desirable to minimize the number of moving parts which require maintenance. In these processors which have few rollers, it is therefore desirable to provide agitation by other means. This can be provided by the use of slot nozzles built into the walls of the thin tanks through which the processing solutions are recirculated at high rates using pumps of sufficiently large capacity to provide the necessary flow rates. This recirculation also ensures that the volume of solutions is fully mixed and has uniform concentrations of components but the flow rates needed to ensure good mixing are lower than that needed to provide impingement agitation.

The delivery of liquid to these slot nozzles is typically provided by tubes or channels which allow uniform flow of solution along the length of the nozzles. These arrangements add volume to the volume of the solution in the tank and thus increase the effective tank volume and solution residence times. They also add to manufacturing cost.

Problem to be Solved by the Invention

Current high capacity multi-strand processors of the "leader belt" type tend to require large volumes of processing solutions. In order to obtain the benefits associated with low volumes of processing solution, for example, low replenishment rates, direct replenishment of concentrates to the processing solutions, minimal effluent and a low flow washing stage, the capacity of such processors must be reduced.

Low volumes of processing solution are not only desirable for developer, bleach or bleach-fix solutions, but also in wash or stabilizer stages as low residence times reduce opportunities for growth of bacteria, etc. However, it is common current practice to use large volumes of wash water to overcome effects of bio-growth since a large volume throughput lowers residence time. This consumes large volumes of water which has either to be treated with expensive equipment and chemicals in order to allow its re-use or it is wasted. Large energy losses also result.

SUMMARY OF THE INVENTION

It is, therefore, an object of the present invention to provide a photographic processing apparatus in which low volumes of processing solutions can be employed.

In accordance with one aspect of the present invention, there is provided photographic processing apparatus for processing at least one continuous web of photographic material, the apparatus comprising a plurality of processing stages and one or more leader belts for transporting the material through each processing stage at a transport speed greater than 5 m/min, each processing stage comprising at least one processing tank, characterized in that the effective tank thickness ($T_T$) for at least one of the processing stages is less than 25 mm.

In a preferred aspect of the invention, a processing channel is defined between a rack inserted in an inner tank, itself located within an outer tank, and the walls of the inner tank, the processing channel comprising a first generally straight section in which the photographic material enters the channel, a second generally straight section through which the photographic material exits the channel, and a turn-around section connecting the first and second sections, said turn-around section having a radius of curvature of a predetermined value, the first and second straight sections having a cross-sectional thickness T and the turn-around section having a cross-sectional thickness TR which is greater than the cross-sectional thickness T.

By the term "effective tank thickness" is meant the ratio of the volume of the processing solution, as hereinafter defined, of a processing stage to the product of the maximum width of the photographic material processed and the path length taken by the photographic material through the processing solution within the tank.

By "tank volume" or "processing solution volume" is meant the volume of the solution within the processing tank/channel together with that of the associated recirculation system, which includes, for example, pipework, valves, pumps, filter housings, etc.

Advantageous Effect of the Invention

By this arrangement, high-capacity processors of the "leader belt" type can be used as low volume processors with all the associated benefits of processing using low volumes.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
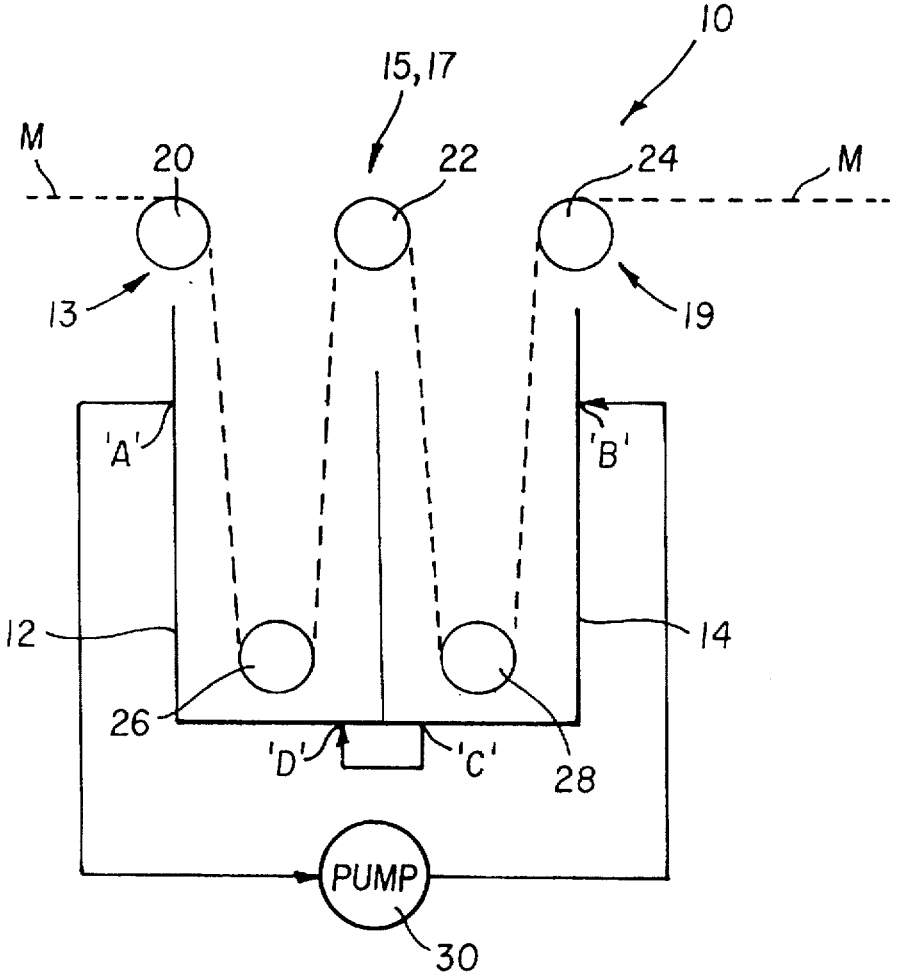
FIG. 1 is a schematic illustration of one processing stage of a known high-capacity processor.

Low solution replenishment rates are desirable since they minimize inefficiencies in chemical use and reduce the chemical effluent and volumes of effluent. Methods of addition of replenishment chemicals directly to processing solutions are well known which allow components of a solution to be kept separate from one another until mixing occurs in the solution in the processing tank. This avoids a chemical mixing operation for replenishment solutions and allows volumes of replenishment solutions to be minimized. The residence times of tank solutions is, however, increased as replenishment rates are reduced thus making low tank volumes of solution within a tank more valuable.

While a processor is continuously being used, the residence time of the solutions therein is a function of processing time, processing tank dimensions, and the fraction of the paper path occupied by paper. The solution residence time can, therefore, be expressed as follows:

$$\text{residence time} \propto \frac{T_T \cdot T_P}{R_R \cdot W_O}$$

$T_T$ is the effective tank thickness as hereinbefore defined;

$T_P$ is the process time (path length for a given process time is not important since as path length increases volume increases but so does the rate of addition of replenishment solutions per unit time);

$R_R$ is the replenishment rate per area of material processed; and $W_O$ is the average fraction of the maximum width of material that can be processed which is occupied by the material being processed.

In order that processing solutions can be maintained fresh, it is desirable to reduce the effective tank thickness so that the solution residence time is reduced. Low residence times are particularly desirable since they offer the opportunity to allow a reduction in replenishing components of the processing solution which are needed to stabilize the chemical content of such solutions against aging effects. These aging effects could be due to atmospheric interactions such as oxidation or acidification or due to the use of solution formulations which use chemically unstable compounds or mixtures. An example of the former is atmospheric oxidation. An example of the latter is the use of bleach/fix solutions in which the fixing component can be oxidized by the bleaching component.

This invention provides a processor for webs of material, typically color negative paper, in which the transport speeds are in excess of 5 m/min (15 ft/min), in which at least one processing tank is of the low volume thin tank type having an effective tank thickness $T_T$ of less than 25 mm. It is preferred that the effective tank thickness $T_T$ is less than 11 mm, preferably less than 5 mm, and particularly less than 3 mm. Each processing channel within the tank is of a width capable of accommodating the widest single-strand of web material or more than one strand of smaller width.

In accordance with the present invention, a processor of the "leader belt" type can be converted to a low volume processor by inserting tank members.

In FIG. 1, one processing stage 10 of a typical high-capacity prior art processor is shown. Processing stage 10 comprises two processing tanks 12,14 located adjacent one another and connected together so that processing solution flows through both tanks. Respective rollers 20,22,24 are located at inlet 13 to tank 12, at outlet 15 to tank 12, inlet 17 to tank 14, and at outlet 19 to tank 14. Rollers 26,28 are also provided in respective ones of the processing tanks 12,14 as shown.

A pump 30 circulates processing solution between the two tanks 12,14 in the direction indicated by the arrows, that is, solution is taken out of tank 12 at "A" and re-introduced into tank 14 at "B", solution passing between tanks 12,14 through a loop connecting point "C" in tank 14 to point "D" in tank 12. Naturally, processing solution flow under control of the pump 30 can also be in the opposite direction to that shown by the arrows.

As shown, material to be processed M, in dotted lines, is directed over roller 20, through tank 12 and around roller 26, over roller 22, through tank 14 and around roller 28, and over roller 24. As discussed above, the material is connected to a "leader belt" (not shown) which is permanently threaded through the processor, the "leader belt" directing the material through each processing stage of the processor. The leader belt takes the material through the processing path as illustrated by dashed lines.

In accordance with the present invention, each processing tank 12,14 of a processing stage 10 is to have its volume for holding processing solution reduced. This is achieved by using a processing tank 40 as shown in FIG. 2.

Figure 2:
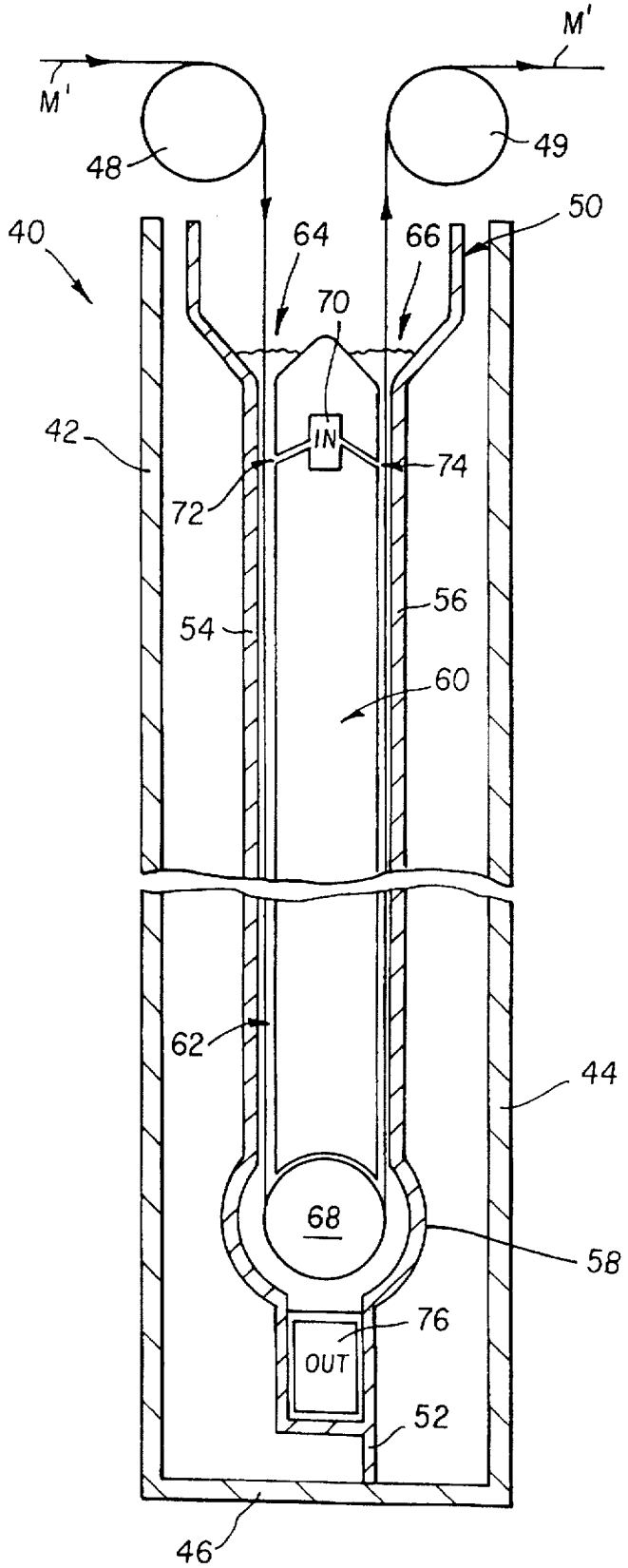
FIG. 2 is detailed illustration of one processing tank forming part of the processing stage shown in FIG. 1.

In FIG. 2, the processing tank 40 comprises external side walls 42,44 and a base wall 46. An inner tank 50 is positioned inside the outer tank 40 and includes a leg member 52 which sits on base wall 46 of outer tank 40. Inner tank 50 comprises wall members 54,56 and a turn-around section 58.

A rack insert 60 is positioned inside inner tank 50 as shown. Rack insert 60, together with wall members 54,56 of inner tank 50, defines a processing channel 62 having a thickness t through which material M' to be processed is directed. The processing channel 62 has an inlet 64 and an outlet 66.

As before, respective rollers 48,49 are provided at the inlet 64 and outlet 66 over which material M' is directed as it passes into and out of tank 40.

As shown, rack insert 60 includes a roller 68 around which the material M' passes as it is directed through the processing channel 62 by the "leader belt" (not shown) to which it is attached by clips (not shown) as is done in processes of this type.

As can be seen in FIG. 2, the processing channel 62 has a thickness T which is designed to be of sufficient width to allow the clip and belt and photosensitive material M' to have uninterrupted passage therethrough, while minimizing the value of processing solution.

The roller 68 has a diameter D which, together with the two thicknesses of the belt, is less than the width WT of the chamber defined by walls 54,56, for insertion and removal purposes, but is preferably equal to or greater than the width RT of the rack 60. This assists in keeping the emulsion side of the material M' from contacting the outer walls 54,56 of rack 60.

Applicants have found that due to the construction of the clip and with going through a sharp radius turn, there exists the possibility that the clip may scrap, damage, or even disengage the belt as it goes around the roller. It is extremely important that the clip not be dislodged or scrapped on the side of the processing tank. This can result in serious damage to the equipment and to the photosensitive material passing through, and thus require substantial amounts of time to repair should it become necessary to remove the clip, not to mention the damage to the customer's photosensitive material. In typical prior art processors where a rack is simply placed in a large tank of solution, if the clip were to disengage the belt, the clip would simply sink to the bottom and stay there until normal maintenance of the tank occurred. However, in a low volume thin processor having a narrow processing channel, it is not possible to wait to remove the dislodged clip. Therefore, to minimize the possibility of the clip hanging up, the lower portion of the processing channel in the area of the turn-around section 58 is made larger in cross-sectional thickness. Thus, the thickness of the processing channel in the turn-around section 58 is made such that the processing channel 62 has a thickness TR, which is greater than the thickness T of the processing straight sections 54,56 of the processing channel 62.

Preferably TR is at least 125% of thickness T, and may be 150% or more, but the value selected should be such as to provide an uninterrupted passage of the belt, clip and photosensitive material M' around the turn-around section 58 while minimizing the volume of processing solution.

Rack insert 60 also includes a solution inlet 70 through which processing solution is pumped into the processing channel 62. Solution inlet 70 comprises nozzles 72,74 which direct processing solution into the processing channel 62. In the embodiment shown, nozzle 72 directs processing solution into the channel 62 in the same direction as the direction of movement of the material M', and nozzle 74 directs processing solution into channel 62 in the opposite direction to that of the direction of movement of the material M'. The nozzles 72,74 are preferably continuous slots across the width of the material to be processed.

Solution is collected from the processing channel 62 through solution outlet 76. Solution outlet 76 is connected to solution inlet 70 by a recirculation system (not shown). Replenishment of the processing solution may be effected in the recirculation system as is well known.

If there are two processing tanks in a processing stage, the solution outlet from the first processing tank is connected to the inlet of the second processing tank, and the solution outlet from the second processing tank is connected to the solution inlet of the first processing tank via the recirculation and/or replenishment systems.

Naturally, if there are more than two processing tanks in a processing stage, the solution inlets and outlets for each tank will be appropriately connected via the recirculation and/or replenishment systems.

It will be appreciated that the connections between the solution inlets and outlets may be such that the processing solution flows from a subsequent tank to a previous tank, that is, counter-current to the direction of travel of the material being processed through the processing tanks, or alternatively, the processing solution flows from a previous tank to a subsequent tank, that is, concurrent with the direction of travel of the material being processed through the processing tanks.

Figure 3:
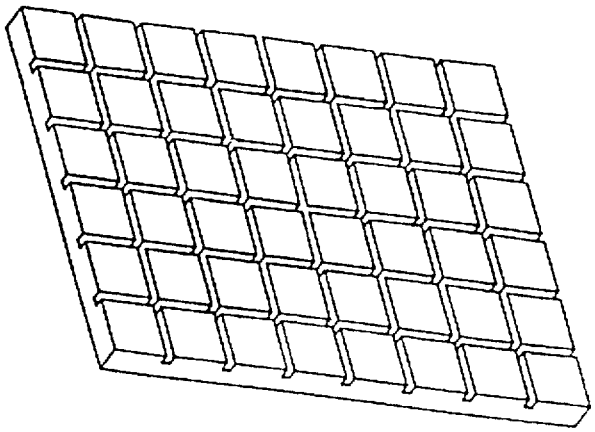
FIGS. 3, 4 and 5 are schematic illustrations of textured surfaces which can be used for walls of the processing tank shown in FIG. 2.
Figure 4:
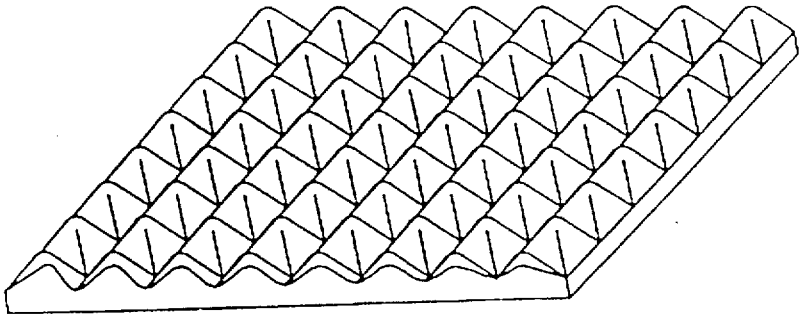
Figure 5:
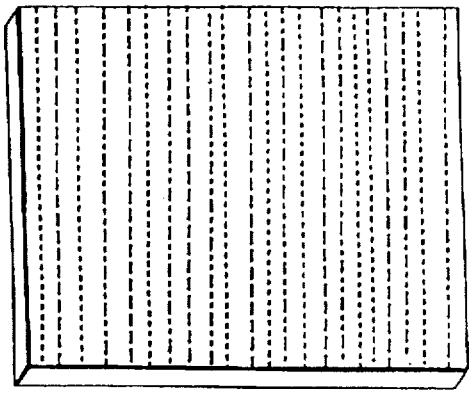

Surface texturing is optionally provided to produce additional turbulence as the web of material and processing solution move past the walls of the inner tank 50, or rack insert 60. FIGS. 3–5 illustrate suitable textured surfaces which may be employed.

The surface shown in FIG. 3 has a first series of parallel channels which are intersected by a further series of parallel channels orthogonally located with respect to the first series of channels which define squares. Similarly, the surfaces shown in FIGS. 4 and 5, respectively, provides a series of diamond or pyramid-shapes or a random pattern.

It has been observed that in a processor of the type described above, that is, with processing tanks similar to that shown in FIG. 2 and for which the transport speed of the material being processed is 6 m/min, the rate of solution flow through slot nozzles 72,74 provide no significant further agitation to that provided by the motion of the material web through the solution, past the tank walls and by contact with the rollers.

A measure of the degree of development which can be used to assess the degree of agitation when all other conditions are constant is the "shoulder density". This is defined here as the density produced on a processed strip of Kodak EKTACOLOR Paper (KODAK and EKTACOLOR are registered trademarks of Eastman Kodak Company) by an exposure which is 0.4 log units greater than the exposure needed to produce a density of 0.8. This can be measured for all three color records of the photographic material, that is, for red, green, and blue. The following table gives the values of the shoulder densities for a range of flow rates through the recirculation pump.

| Recirculation rate | Shoulder density | | |
|---|---|---|---|
| (gals/min) | Red | Green | Blue |
| 0 | 2.25 | 2.22 | 2.06 |
| 10 | 2.24 | 2.22 | 2.08 |
| 20 | 2.24 | 2.21 | 2.07 |
| 27 | 2.23 | 2.20 | 2.08 |

It can, therefore, be seen that it is possible to use a flow rate sufficient only for recirculation to ensure uniformity of processing solution chemical concentrations and temperature. This allows the number of slot nozzles and the power of pumps used to be minimized thus saving total solution volume and manufacturing costs. This means that the rack insert described above may only have one orifice or slot nozzle (not shown) through which processing solution is introduced into the processing channel.

It will be readily appreciated that tanks containing low volumes of processing solution in accordance with the present invention can be obtained by retro-fitting existing processing tanks, such as tanks 12,14 in FIG. 1, with inner tank 50 in FIG. 2. In this case, outer tank 40 will comprises tanks 12 or 14.

The invention can be used in combination with direct replenishment, replenishment with solids, redox amplification development processes, multi-stage counter-current washing.

It can also be used to process color papers using substantially pure chloride emulsions and pyrazolone and PT couplers.

It is to be understood that various other changes and modifications may be made without departing from the scope of the present invention. The present invention being limited by the following claims.

Parts list

10 . . . processing stage
12,14 . . . processing tanks
13,17 . . . inlet
15,19 . . . outlet
20,22,24,26,28 . . . rollers
30 . . . pump
40 . . . processing tank
42,44 . . . side walls 46 . . . base wall 48,49 . . . rollers 50 . . . inner tank 54,56 . . . wall members 58 . . . turn-around section 60 . . . rack insert 62 . . . processing channel 64 . . . inlet 66 . . . outlet 68 . . . roller 70 . . . solution inlet 72,74 . . . nozzles 76 . . . solution outlet

We claim:

1. A photographic processing apparatus for processing at least one continuous web of photographic material, the apparatus comprising a plurality of processing stages and at least one leader belt for transporting the material through each processing stage at a transport speed greater than 5 m/min, each processing stage comprising at least one processing tank, wherein an effective tank thickness for at least one of the processing stages is less than 25 mm.

2. Apparatus according to claim 1, wherein each processing tank is capable of processing at least two webs of photographic material in parallel, the transport for the webs being provided by said at least one leader belt and a further leader belt to which each web is attached.

3. Apparatus according to claim 1, wherein the effective tank thickness is less than 11 mm.

4. Apparatus according to claim 1, wherein the effective tank thickness is less than 5 mm.

5. Apparatus according to claim 1, wherein the effective tank thickness is less than 3 mm.

6. A photographic processing apparatus for processing at least one continuous web of photographic material, the apparatus comprising a plurality of processing stages and at least one leader belt for transporting the material through each processing stage at a transport speed greater than 5 m/min, each processing stage comprising at least one processing tank, the apparatus further including an inner tank located within an outer tank, the inner tank having a volume for holding processing solution which is substantially lower than that of the outer tank, wherein an effective tank thickness for at least one of the processing stages is less than 25 mm.

7. Apparatus according to claim 6, wherein a rack insert is provided inside the inner tank to further reduce the processing solution volume, and to define a processing channel between the inner tank and the rack insert through which the material to be processed passes.

8. Apparatus according to claim 7 wherein the processing channel comprises a first generally straight section in which the photographic material enters the channel, a second generally straight section through which the photographic material exits the channel, and a turn-around section connecting the first and second sections, said turn-around section having a radius of curvature of a predetermined value, the first and second straight sections having a cross-sectional thickness T and the turn-around section having a cross-sectional thickness TR which is greater than the cross-sectional thickness T.

9. Apparatus according to claim 8 wherein the thickness TR is equal to or greater than 125% of the thickness T.

10. Apparatus according to claim 8 wherein the turn-around section has a guide roller having a diameter equal to or greater than a width of the rack.

11. Apparatus according to claim 6 wherein the inner tank has textured surfaces.

12. Apparatus according to claim 7 wherein the rack insert has textured surfaces.

13. Apparatus according to claim 7 wherein the rack insert has only one orifice through which processing solution is introduced into the processing channel.

14. Apparatus according to claim 7 wherein the rack insert includes at least one nozzle for introducing processing solution into the processing channel.

15. A photographic processing apparatus for processing at least one continuous web of photographic material, the apparatus comprising:

(a) a plurality of processing stages; and (b) at least one leader belt for transporting the material through each processing stage at a transport speed greater than 5 m/min;

wherein:

each processing stage comprises at least one processing tank containing a rack insert, such that a processing channel is defined between the tank and the rack insert through which the material to be processed passes;

the processing channel comprises a first generally straight section in which the photographic material enters the channel, a second generally straight section through which the photographic material exits the channel, and a turn-around section connecting the first and second sections, said turn-around section having a radius of curvature of a predetermined value, the first and second straight sections having a cross-sectional thickness T and the turn-around section having a cross-sectional thickness TR which is greater than the cross-sectional thickness T; and an effective tank thickness for at least one of the processing stages is less than 25 mm.

16. Apparatus according to claim 15 wherein the thickness TR is equal to or greater than 125% of the thickness T.

17. Apparatus according to claim 15 wherein the turn-around section has a guide roller having a diameter equal to or greater than a width of the rack.

* * * * *